US008161722B2

(12) United States Patent
Chiasson et al.

(10) Patent No.: US 8,161,722 B2
(45) Date of Patent: Apr. 24, 2012

(54) CABLE STRANDING METHODS EMPLOYING A HOLLOW-SHAFT GUIDE MEMBER DRIVER

(75) Inventors: David W. Chiasson, Edmonton (CA); Craig M. Conrad, Hickory, NC (US); Jonathan E. Moon, Greensboro, NC (US); Mark W. Petersen, Winston-Salem, NC (US); David H. Smith, Hickory, NC (US)

(73) Assignee: Corning Cable Systems LLC, Hickory, NC (US)

( * ) Notice: Subject to any disclaimer, the term of this patent is extended or adjusted under 35 U.S.C. 154(b) by 338 days.

(21) Appl. No.: 12/571,104

(22) Filed: Sep. 30, 2009

(65) Prior Publication Data

US 2011/0072775 A1 Mar. 31, 2011

(51) Int. Cl.
*D02G 3/00* (2006.01)

(52) U.S. Cl. ..... 57/293

(58) Field of Classification Search ..... 57/293, 57/294

See application file for complete search history.

(56) References Cited

U.S. PATENT DOCUMENTS

| | | | | |
|---|---|---|---|---|
| 3,572,024 | A * | 3/1971 | Lyons | 57/3 |
| 4,205,899 | A * | 6/1980 | King et al. | 385/100 |
| 4,813,223 | A * | 3/1989 | Nipper et al. | 57/294 |
| 4,856,266 | A * | 8/1989 | Ogawa et al. | 57/9 |
| 5,237,809 | A | 8/1993 | Oestreich et al. | 57/293 |
| 5,307,617 | A * | 5/1994 | Karhu | 57/293 |
| 5,546,741 | A | 8/1996 | Karhu | 57/293 |
| 5,699,660 | A | 12/1997 | Buluschek | 57/293 |
| 5,799,477 | A * | 9/1998 | Seibert | 57/293 |
| 6,634,164 | B2 * | 10/2003 | Moser et al. | 57/293 |

* cited by examiner

*Primary Examiner* — Shaun R Hurley
(74) *Attorney, Agent, or Firm* — Russell S. Magaziner

(57) ABSTRACT

Cable-stranding methods for performing SZ-stranding of strand elements about at least one core member are disclosed. One method includes passing initially spaced apart strand elements through peripheral guide holes and passing at least one core member through a generally central location of at least one guide member. The method also includes actuating a controller that controls the rotation of the at least one guide member and rotating the at least one guide member to form the SZ-stranded assembly.

23 Claims, 5 Drawing Sheets

CABLE STRANDING METHODS EMPLOYING A HOLLOW-SHAFT GUIDE MEMBER DRIVER

CROSS-REFERENCE TO RELATED APPLICATIONS

This Application is related to U.S. patent application Ser. No. 12/571,052, entitled "Cable Stranding Apparatus Employing a Hollow-Shaft Guide Member Driver," filed on the same day of Sep. 30, 2011, and which is assigned to the same Assignee as the present Application, and which is incorporated by reference herein.

FIELD

The present disclosure relates to methods for stranding together strand and core members to form stranded cables with an alternating twist direction, and in particular to such methods that employ a hollow-shaft guide member driver.

BACKGROUND

Cable stranding machines are used in cable manufacturing to form cables with multiple strand elements ("strands") having an alternating twist direction. Such cables are called "SZ" cables because the strands periodically helically twist in opposing "S" and "Z" directions. The SZ stranding configuration eliminates the need for the strand storage containers to be rotated around the cable core member, thereby resulting in less complex, faster-operating stranding machinery.

The strands, which can be wire, optical fibers, buffer tubes, etc., are stored in storage containers (e.g., spools or "packages") and pass through a stationary guide or "layplate." The layplate keeps the strands locally spaced apart as they pass through to a downstream SZ cable-stranding apparatus. Prior art SZ cable-stranding apparatus employ a series of axially arranged and mechanically coupled guides typically in the form of non-stationary (i.e., rotatable) plates called "layplates" similar if not identical to the stationary layplate. The rotatable layplates also serves to keep the strands locally spaced apart during the stranding process to ensure that the strands do not become entangled with each other or the core member as the layplates rotate through their motion profiles.

In the process of forming an SZ-stranded cable, the layplates are mechanically coupled and driven in alternating rotational directions at progressively slower rates towards the upstream stationary plate as the strands move through the layplates. An SZ-stranded assembly, consisting of the strands wound around the central core member, emerges from the most downstream rotatable layplate.

In the simplest form of SZ cable-stranding apparatus, tension in the strands provides the mechanical coupling that rotates the layplates. However, this results in poor tension control with a limited range of layplate rotation. More complex and expensive approaches use a series of shafts from a drive member ("prime mover") and belts and/or gears to synchronize the motion of the rotating layplates to generate the required rotation rate for each layplate. An example of this type of SZ cable-stranding apparatus uses an elastic shaft running parallel to the axis of the oscillator. The torsion of the shaft, in combination with an arrangement of belts, pulleys and/or gears, drives the layplates.

Generally, mechanically based SZ cable-stranding apparatus are expensive and difficult to maintain. Furthermore, the added rotational inertia of the mechanical components limits the maximum rate at which the rotatable layplates can reverse directions, thereby limiting both line speed and performance. In addition, the mechanical components limit the relative speed differences between successive layplates. This makes it difficult if not impossible to decouple the operation of the individual layplates to optimize the layplate rotational speeds to achieve the smoothest possible SZ stranding operation.

SUMMARY

An aspect of the disclosure is a method of stranding strand elements in an SZ configuration to form an SZ-stranded assembly. The method comprises passing, through at least one guide member, initially spaced apart strand elements through respective guide holes and at least one core member through a generally central location of the guide member. The method also includes actuating a controller that controls the rotation of the guide member and rotating the guide member to form the SZ-stranded assembly.

Another aspect of the disclosure is a method of forming an apparatus for controlling strand elements and at least one core member in a stranding apparatus. The method includes providing at least one motor having an associated rotating guide member driver. The method also includes providing and operably disposing a guide member at least partially within the rotating guide member driver so that the guide member rotates with the guide member driver, wherein the guide member is configured to receive and individually guide the strand elements and pass the at least one core member.

Another aspect of the disclosure a method of forming a cable stranding apparatus that strands strand elements about at least one core member in an SZ configuration to form a SZ-stranded assembly. The method includes providing a plurality of motors each having a guide member driver, and aligning the guide member drivers along an apparatus axis. The method also includes providing a plurality of guide members configured to locally spatially separate the individual strand elements and pass the at least one core member. The method further includes disposing and holding stationary one of the guide members upstream of the plurality of motors. The method additionally includes disposing the remaining guide members at least partially within respective guide member drivers so that they rotate with the respective guide member drivers.

These and other advantages of the disclosure will be further understood and appreciated by those skilled in the art by reference to the following written specification, claims and appended drawings.

BRIEF DESCRIPTION OF THE DRAWINGS

A more complete understanding of the present disclosure may be had by reference to the following detailed description when taken in conjunction with the accompanying drawings, wherein.

DETAILED DESCRIPTION

Reference is now made to embodiments of the disclosure, exemplary embodiments of which are illustrated in the accompanying drawings. In the description below, like elements and components are assigned like reference numbers or symbols. Also, the terms "upstream" and "downstream" are relative to the direction in which the SZ-stranded cable is formed, starting upstream with the various unstranded strand elements and optional at least one core member, and ending downstream with the formed SZ-stranded assembly and SZ-stranded cable.

Figure 1:
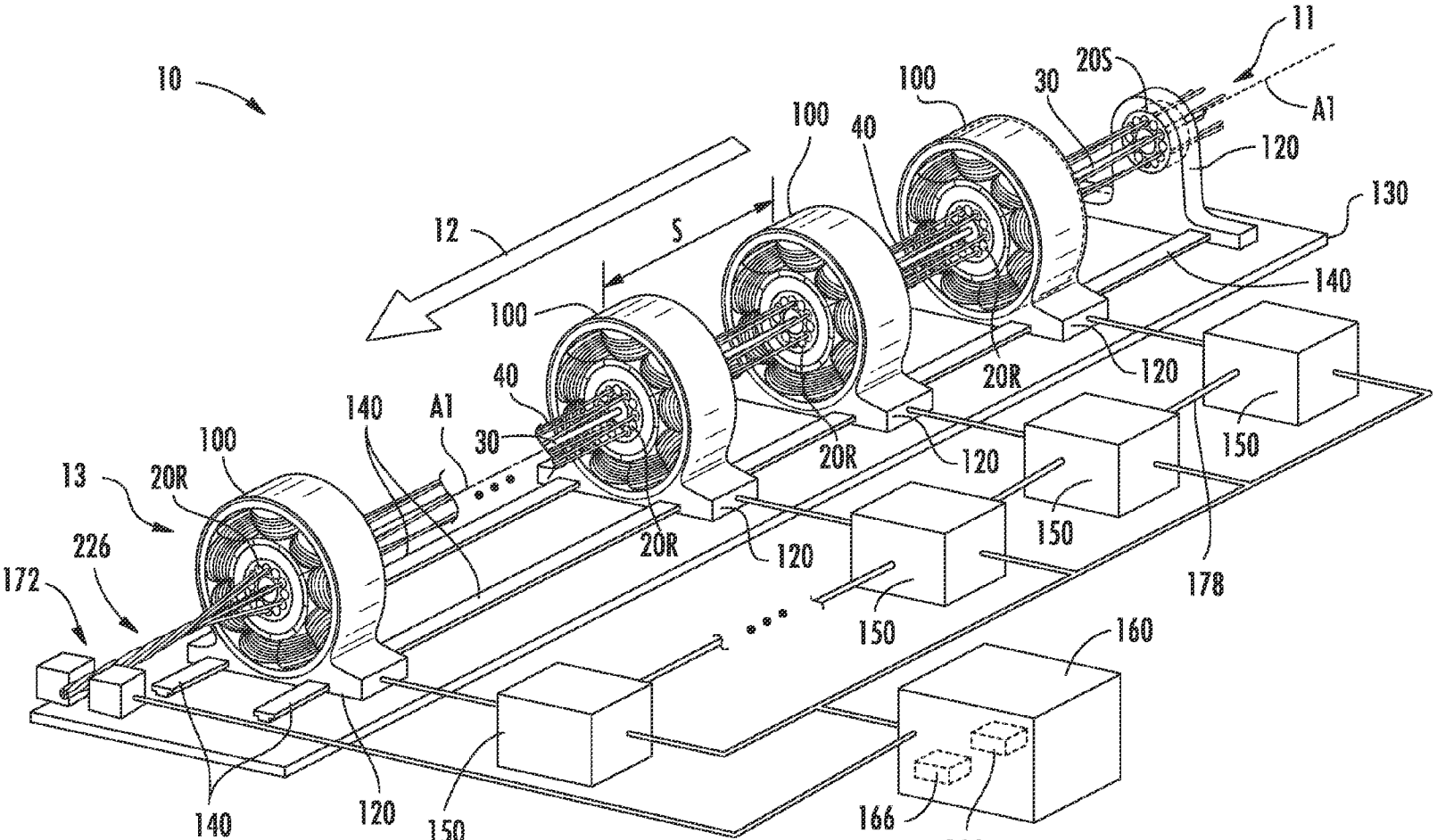
FIG. 1 is a perspective view of an example SZ cable-stranding apparatus according to the present disclosure.

FIG. 1 is a perspective view of an example SZ cable-stranding apparatus ("apparatus") 10 according to the present disclosure. Apparatus 10 has an upstream input end 11 and a downstream output end 13. Apparatus 10 includes along an axis A1 in order from an upstream to a downstream direction as indicated by arrow 12, a stationary guide member 20S and at least one hollow-shaft motor 100 that includes a rotatable guide member 20R operably disposed therein. Here, the term "rotatable" refers to the fact that motor 100 causes the guide member to rotate, as described in greater detail below. FIG. 1 shows an example configuration of apparatus 10 having a plurality of axially aligned motors 100. An example type of motor 100 is a high-precision motor such as a servo motor.

In an example embodiment, adjacent motors 100 are spaced apart by respective distances S, which in many cases is governed by space constraints and the fact that larger guide-member separations result in lower tension variation in the strands. A typical spacing S between motors 100 is between 0.1 m and 2 m, and in an example embodiment the spacing is adjustable, as described below. In some example embodiments, the spacing S is equal between all motors 100, while in other example embodiments the spacing S is equal between some motors, while in other example embodiments the spacing S is not equal between any of the motors. Providing a variable spacing S between motors 100 may be used to adjust the stranding process. For example, a large spacing downstream helps minimize tension variation while a short spacing upstream shortens the overall length of apparatus 10 with little impact on tension variation.

Figure 2:
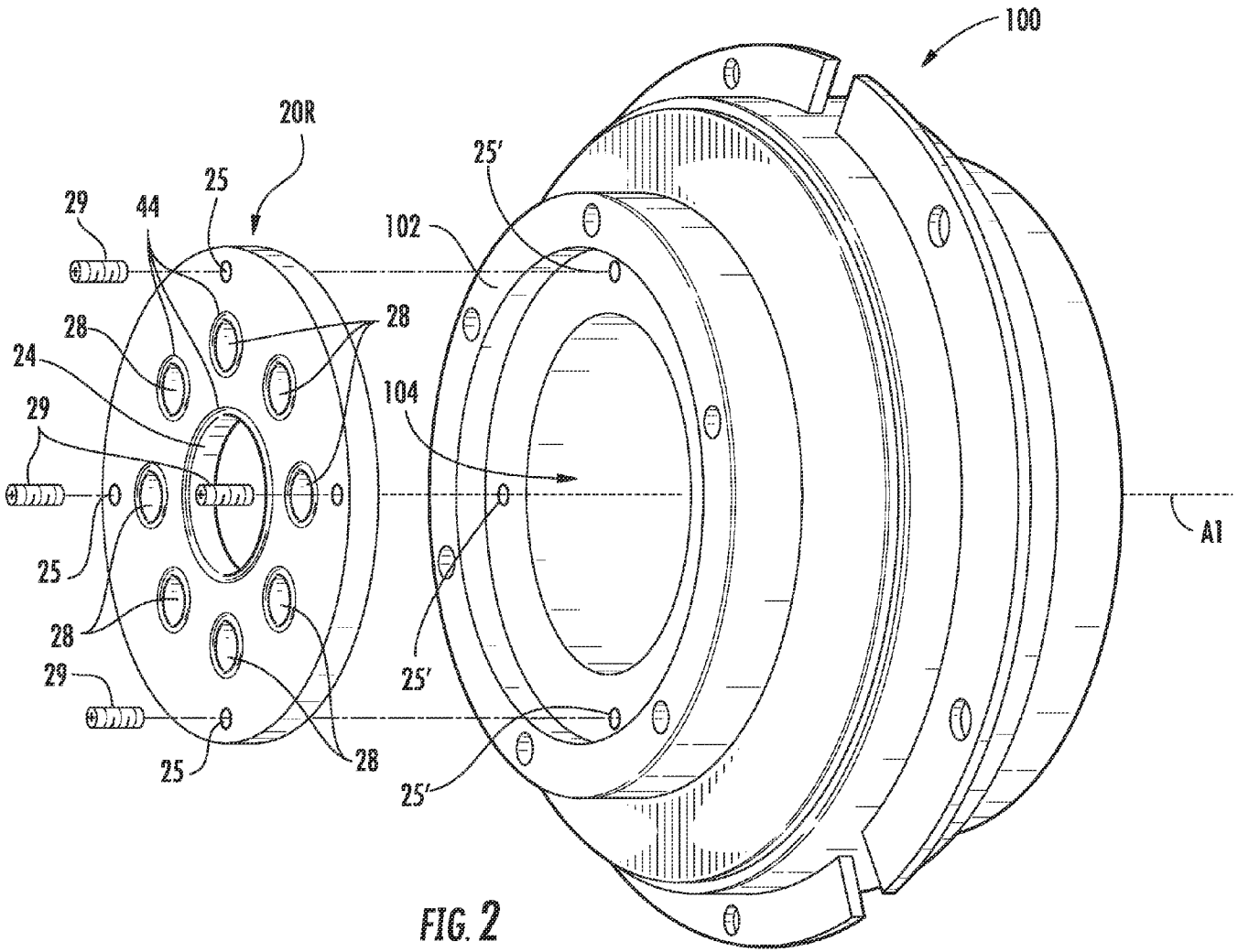
FIG. 2 is a perspective view of an example hollow-shaft motor showing an exploded view of a guide member attached to the hollow shaft via set screws.

FIG. 2 is a perspective view of an example motor 100. Motor 100 includes a guide member driver in the form of a hollow shaft 102 defined by an axial shaft hole 104 formed therein. An example size of shaft hole 104 is between 1 and 3 inches in diameter, with 2 inches being a commonly available size suitable for use in forming many types of SZ cables. The term "hollow shaft" as used herein in connection with motor 100 is intended to include a motor that contains a through passage concentric with and contained within the rotating structure of the motor. For example, certain types of servo-motors suitable for use herein and discussed in greater detail below include inductively driven rotors that surround and drive a hollow shaft.

Each motor 100 includes the aforementioned rotatable guide member 20R operably disposed within shaft hole 104 (see FIG. 1) so that the guide member rotates with the rotation of the hollow shaft. In an example embodiment, rotatable guide member 20R is disposed in shaft hole 104 and is fixed to hollow shaft 102 by, for example, by set screws (as described below), an adhesive, a flexible or rigid mounting member or fixture, or other known fixing means.

Each motor 100 includes a position feedback device 106, such as an optical encoder (see FIG. 5, introduced and discussed below). Positional feedback device 106 provides information (in the form of an electrical signal S3) about the rotational position and speed of hollow shaft 102 and thus rotatable guide member 20R. An example maximum rotational speed of motor 100 is 3,600 rpm and an example maximum theoretical acceleration is 21,582 rad/s$^2$. A typical operating rotational speed for motor 100 used in producing SZ cable is about 1,500 rpm with an angular acceleration of about 8,000 rad/s$^2$. An exemplary motor 100 for use in apparatus 10 is one of the model nos. CM-4000 hollow-shaft inductively driven servo motors made by Computer Optical Products, Inc., Chatsworth, Calif. Another exemplary motor 100 for use in apparatus 10 is a hollow-shaft gear-based motor, such as those available from Bodine Electric Company, Chicago, Ill.

Figure 3:
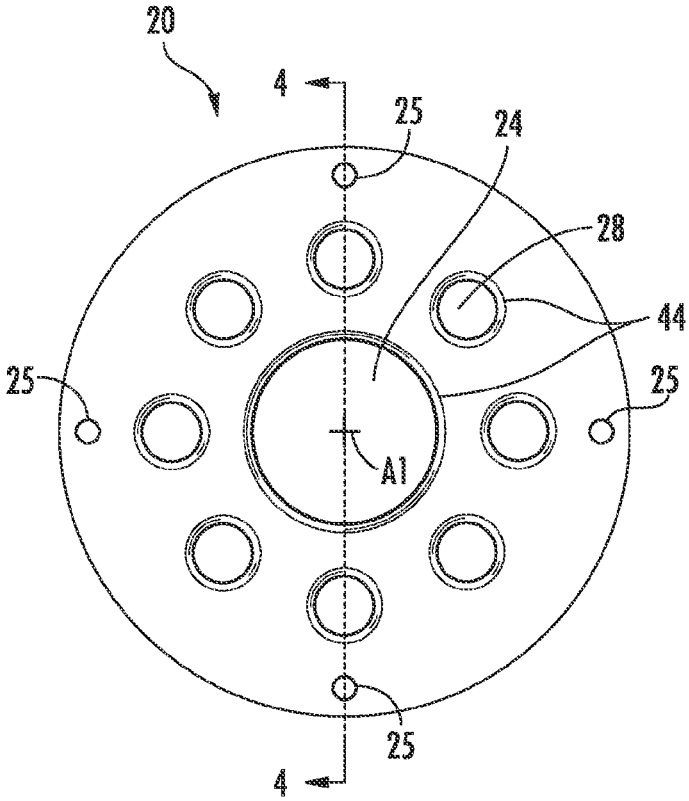
FIG. 3 is a front-on view.
Figure 4:
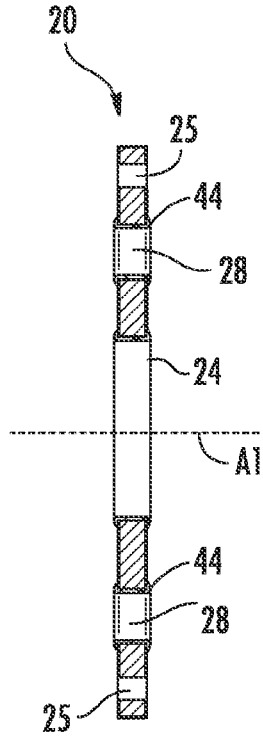
FIG. 4 is a cross-sectional view of an example guide member of FIG. 2 in the form of a layplate having a central hole sized to pass the at least one core member, surrounding strand guide holes, and peripheral set-screw holes.

FIG. 3 is a face-on view and FIG. 4 is a cross-sectional view of an example guide member 20 that can be used as stationary guide member 20S and/or as rotatable guide member 20R. The example guide member 20 is in the form of a round plate ("layplate") having a central hole 24 with peripherally arranged smaller guide holes (e.g., eyelets) 28 (six guide holes are shown by way of example). Central hole 24 is sized to pass at least one core member 30 while guide holes 28 are sized to pass individual strand elements ("strands") 40. Core member 30 includes, for example, a strength element and/or a cable core member. An example strength element is glass-reinforced plastic (GRP), steel or like strength elements presently used in SZ cables. Example cable core members 30 include buffer tubes, optical fibers, optical fiber cables, conducting wires, insulating wires, and like core members presently used in SZ cables. Example strands 40 include optical fibers, buffer tubes, wires, thread, copper twisted pairs, etc.

Guide member 20 is arranged in apparatus 10 so that central hole 24 is centered on axis A1, and in an example embodiment peripheral guide holes 28 are arranged symmetrically about the central hole. Guide member 20 is configured to maintain the at least one core member 30 and individual strands 40 in a locally spaced apart configuration as the core member and individual strands pass through their respective holes. An example guide member 20 is formed from aluminum. Guide member 20 optionally includes hole liners 44 that line central hole 24 and/or guide holes 28 in a manner that facilitates the passing of core member 30 and/or strands 40 through the guide member. Example materials for hole liners 44 include ceramic, plastic, TEFLON, and like materials. Hole liners 44 preferably have rounded edges that reduce the possibility of core member 30 and/or strands 40 from being snagged, abraded, nicked or cut as they pass through their respective holes. In another example embodiment, central hole 24 and guide holes 28 are provided with rounded edges.

With reference to FIG. 2 through FIG. 4, in an example embodiment, rotatable guide member 20R includes peripheral set-screw holes 25, and hollow shaft 102 includes matching screw holes 25' configured so that the rotatable guide member is attached to the hollow shaft via corresponding set screws 29.

In an example embodiment, rotatable guide member 20R is the same as or is similar to stationary guide member 20S, and further in an example embodiment are both in the form of layplates such as shown in FIG. 3 and FIG. 4. Motors 100 are axially aligned so that shaft hole 104 and the rotatable guide member 20R operably disposed therein are centered on axis A1.

With reference again to FIG. 1, in an example embodiment, stationary guide member 20S and each motor 100 are mounted to respective base fixtures 120, which in turn are mounted to a common platform 130, such as a base plate or tabletop. In an example embodiment, base fixtures 120 are configured to be fixed in place to platform 130, while in another example embodiment they are also configured to be positionally adjustable relative to platform 130. In one example, the positional adjustability is achieved by slidably mounting base fixtures 120 to rails 140, which allows for axial adjustability of each motor 100. Movable motors 100 can be axially moved along rails 140 and placed together for "thread up," i.e., threading the at least one core member 30 and strands 40 through their respective holes 24 and 28 in the various rotatable guide members 20R, and then axially moved again along the rails to be spaced apart and fixed at select positions during the SZ stranding operation, as discussed below. The positional adjustability of motors 100 allows for the spacings S to be changed so that apparatus 10 can be reconfigured for forming different types of SZ cables or to tune the cable-forming process. In an example embodiment, base fixtures 120 and platform 130 (and optional rails 140) are configured so that motors 100 can be added or removed from apparatus 10.

Figure 5:
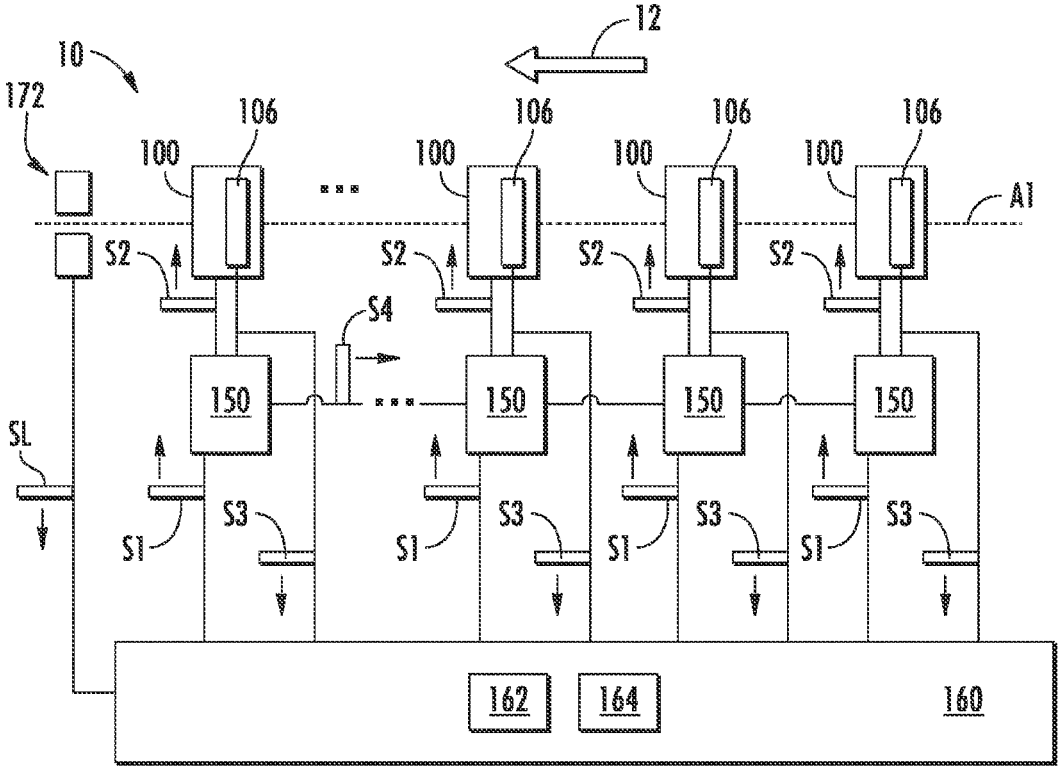
FIG. 5 is a schematic diagram of an example electronic configuration of the SZ cable-stranding apparatus.

With continuing reference to FIG. 1 and also to the schematic diagram of FIG. 5, an example apparatus 10 includes at least one servo driver 150 electrically connected to the corresponding at least one motor 100. Each servo driver 150 is in turn operably connected to a controller 160. An example controller 160 is a programmable logic controller (PLC), or a microcontroller. An example controller 160 includes a processor 164 and a memory unit 166, which constitutes a computer-readable medium for storing instructions, such as a rotation relationship embodied as an electronic gearing profile, to be carried out by the processor in controlling the operation of apparatus 10. An exemplary controller 160 suitable for use in the present disclosure is Model No. PiC900 PLC made by Giddings and Lewis, LLC, Fond du Lac, Wis.

Apparatus 10 also includes a linespeed monitoring device 172 operably arranged to measure the speed at which the SZ-stranded assembly 226 or core member 30 travels through the apparatus. Example locations for linespeed monitoring device 172 include downstream of the most downstream motor 100 and adjacent SZ-stranded assembly 226 as shown, or upstream of stationary guide member 20S and adjacent core member 30. Intermediate locations can also be used. Linespeed monitoring device 172 is electrically connected to controller 160 and provides a linespeed signal SL thereto. An example linespeed monitoring device 172 is the BETA QUADRATRAK II linespeed monitor, available from Beta LaserMike USA, Inc., Dayton, Ohio.

In an example embodiment, controller 160 includes instructions (i.e., is programmed with instructions stored in memory unit 166) that control the rotational speed and the reversal of rotation of each motor 100 according to a rotation relationship. This rotation relationship between motors 100 is accomplished via motor control signals S1 provided by controller 160 to the corresponding servo drivers 150. In an example embodiment, the rotation relationship is embodied as electronic gearing. In response thereto, each servo driver 150 provides its corresponding motor 100 with a power signal S2 that powers the motor and drives it at a select speed and rotation direction according to the rotation relationship. Position feedback device 106 provides a position signal S3 that in an example embodiment includes incremental positional information, speed information, and an absolute (reference) position. The reference position is typically a start position of hollow shaft 102, while the incremental position tracks its rotational position on a regular basis (e.g., 36,000 counts per rotation). The rotational speed of hollow shaft 102 is the change in rotational position with time and is obtained from the position information contained in signal S3. Linespeed signal SL provides linespeed information, which is useful for comparing to the rotational speeds of motors 100 to ensure that the rotational speed and linespeed are consistent with the operational parameters of apparatus 10 and the particular SZ-cable being fabricated.

For apparatus 10 having a plurality of motors 100, each motor has a different rotational speed, with less rotational speed the farther upstream the motor resides. For an SZ stranded cable, the number n of "turns between reversals'" can vary, with a typical number being n=8. For this example number of turns between reversals, apparatus 10 starts at a neutral point (n=0) where all of the strands 30 and the rotational and stationary guide members 20R and 20S are aligned. Controller 160, through the operation of servo drivers 150, then causes motors 100 to execute four turns clockwise, and then reverse and execute eight turns counterclockwise. Note that after the first four counterclockwise turns, apparatus 10 returns to and then passes through the neutral point. After the eight counterclockwise turns, apparatus 10 reverses and performes eight clockwise turns. In this way, n=8 turns between reversals is obtained, with rotatable guide members 20R turning four turns around the neutral point in each direction.

For apparatus 10 designed to operate with a maximum angular deviation of 120° between two successive rotatable guide members 20R, the 120° needs to be divided between four turns, or 30° per turn. Thus, as the "first" or most downstream rotatable guide member 20R undergoes its first revolution, the second (i.e., second most downstream rotatable guide member) must lag the first by 30°, i.e., it only turns 11/12 (i.e., 0.92) of a revolution. This defines the base rotation ratio R, i.e., the range of rotation between the second and first most downstream motors.

Consider an example for n=+/−4 turns and a maximum angular displacement between two rotatable guide members 20R of $\theta_{MAX}$=120°. The first rotatable guide member turns a total angle of $\theta_T$=1440° (n*360), the second turns 1320°, the third 1200° and so on. The second rotatable guide member 20R is then driven at a ratio $R_2$=1320/1440=0.92. The third guide member 20R is driven at a ratio $R_3$=1200/1320 or 0.91. Generally, for j=the rotatable guide member number, $\theta_{MAX}$=the separation angle, $\theta_T$=the total angular rotation (n*360°) for the first guide member, the rotation ratio $R_j$ of guide member j=2, 3, . . . relative to the first guide member is given by $R_j=1-(j-1)*\theta_{MAX}/\theta_T$.

Example rotation relationships for motors 100 are carried out in a similar manner for different numbers n of turns between reversals, a different total number m of motors, and a different maximum angular deviation $\theta_{MAX}$ between adjacent guide members. The number m of motors 100 needed in apparatus 10 generally depends on the type of SZ cable being formed and related factors, such as the maximum number n of turns between reversals, and $\theta_{MAX}$, which in turn depends on the guide member diameter, the size of the core member 30 and the size of strands 40. A typical number m of motors 100 ranges from 1 to 20, with between 5 and 12 being a common number for a wide range of SZ cable applications.

Apparatus 10 can be configured and operated in a number of ways. For example, rather than controller 160 controlling each individual servo driver 150, in one embodiment the servo drivers are linked together via a communication line 178 and receive information about the rotation of the most downstream motor 100 via an electrical signal S4. The upstream servo drivers 150 then calculate the required motor signals S2 needed to provide the appropriate rotation relationship (e.g., via electronic gearing) to their respective motors 100. Thus, controller 160 transmits information via signal S1 about the stranding profile (n turns between reversals, the laylength, etc. . . . ) to the first (i.e., most downstream) servo driver 150. Each upstream servo driver 150 receives a master/slave profile (e.g. a gear ratio=R) for the motor 100 immediately in front of it via respective signals S4. Thus, the upstream servo drivers 150 are slaved to the most downstream servo driver. In this embodiment, controller 160 is mainly for initiating and then monitoring the operation of apparatus 10. Linespeed information is provided to the most downstream servo driver 150 through controller 160 (i.e., from linespeed monitoring device 178 to controller 160 and then to the most downstream servo driver).

In a related embodiment, controller 160 transmits the aforementioned stranding profile information via signal S1 to first servo driver 150, while each upstream servo driver receives a master/slave profile (e.g. a gear ratio=R) that synchronizes them to the downstream servo driver. Since each upstream servo driver 150 is slaved to the most downstream servo driver, each servo driver requires the position feedback data from the first motor 100. Linespeed information is provided to the first servo driver 150 through controller 160.

In another related embodiment, controller 160 transmits the aforementioned stranding profile information to the first servo driver 150. Controller 160 also calculates an individualized stranding profile for each upstream motor 100 based on the complete stranding profile that will result in a desired operation for apparatus 10. In this case, there are no rotational master/slave relationships between motors 100. Since each motor 100 operates independently of the others, each requires linespeed feedback from linespeed monitoring device 178 and only its own position information. In an example embodiment, the linespeed feedback is provided via controller 160.

Thus, in one embodiment, each motor 100 is programmed to rotate with a select speed that is not necessarily slaved of off the "base" rotation ratio R. In an example embodiment, the rotation relationship between the motors has a non-linear form selected to optimize the SZ stranding process. The rotation relationship between two adjacent rotatable guide members 20R can best be visualized as a function of the angular position $\theta_M$ of a "master" guide member 20R and the angular position $\theta_S$ of a corresponding "slave" guide members. Thus, for a prior art mechanical system where the rotation ratio R is fixed, the angular position $\theta_S$ of the slave guide member is determined by the function $\theta_S=R*\theta_M$, which is a linear function in θ. In contrast, the rotation relationship programmed into controller 160 can allow for a much more complex functional relationships between the angular positions and rotation speeds of guide members 20. A non-linear rotation relationship is useful, for example, to minimize tension spikes that can occur during the SZ stranding operation.

Figure 6:
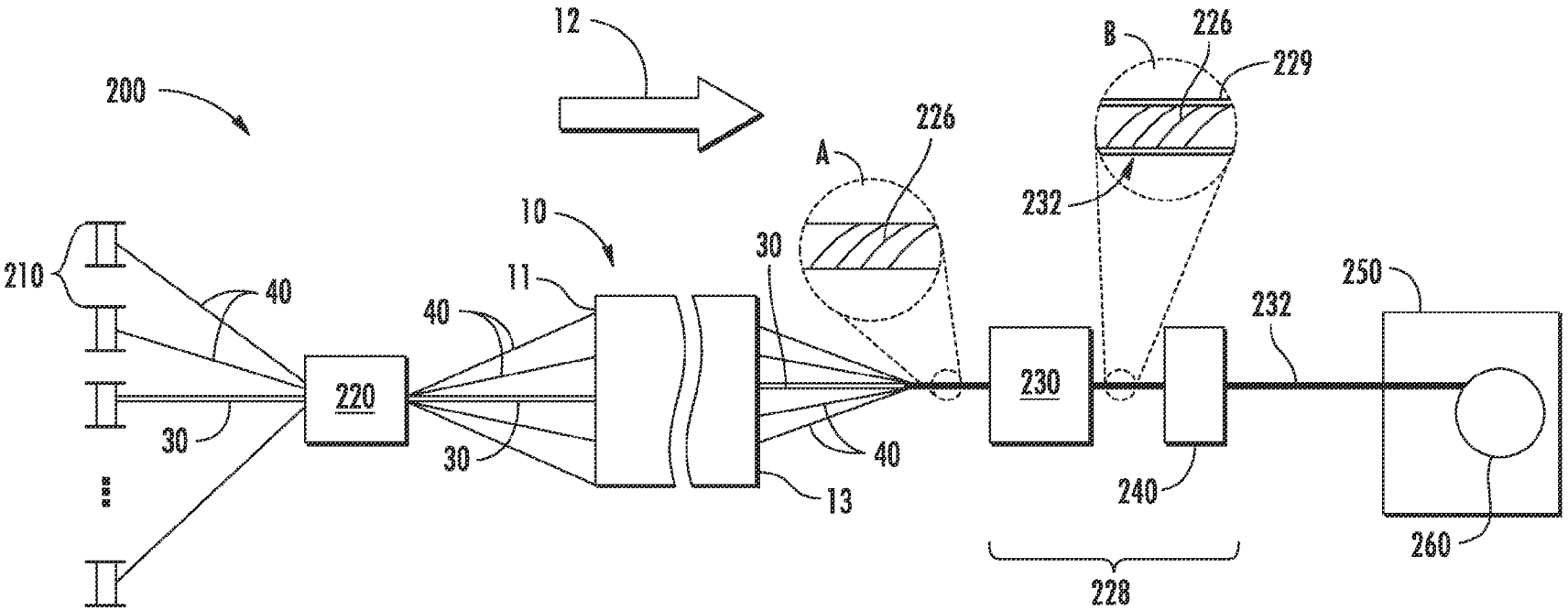
FIG. 6 is a schematic overall view of a SZ cable-forming system that includes the SZ cable-stranding apparatus of the present disclosure.

FIG. 6 is a schematic diagram of an example SZ cable-forming system ("system") 200 that includes apparatus 10 of the present disclosure. System 200 includes strand storage containers 210, typically in the form of spools or "packages" that respectively hold and pay off individual strands 40 and optionally one or more individual core members 30.

System 200 include a strand-guide device 220 arranged immediately downstream of strand storage containers 210. In an example embodiment, strand-guide device 220 includes a series of pulleys (not shown) that collect and distribute the strands 40 and the at least one core member 30. SZ cable-stranding apparatus 10 is arranged immediately downstream of strand-guide device 220 and receives at its input end 11 the strands 40 and the at least one core member 30 outputted from the strand-guide device. Apparatus 10 then performs SZ-stranding of the strands about the at least one core member 30, as described above. Strands 40 and the optional core member 30 exit apparatus 10 at output end 13 as an SZ-stranded assembly 226, as shown in the close-up view of inset A of FIG. 6 (see also FIG. 1). SZ-stranded assembly 226 consists of strands 40 wound around the at least one core member 30 in an SZ configuration.

System 200 includes a coating unit 228 arranged immediately downstream of apparatus 10. Coating unit includes an extrusion station 230 configured to receive the SZ-stranded assembly 226 and form a protective coating 229 thereon, as shown in the close-up view of inset B in FIG. 6, thereby forming the final SZ cable 232. In an example embodiment, extrusion station 230 includes a cross-head die (not shown) configured to combine the protective coating extrusion material with the SZ-stranded assembly. Example coatings 228 include polyethylene (PE), polyvinyl chloride (PVC), Poly Vinyl Diene Fluorine (PVDF), Nylon, Poly Tetra Flouro Ethylene (PTFE), etc. Coating unit 228 also includes a cooling and drying station 240 is arranged immediately downstream of extrusion station and cools and dries coating 228. The final SZ cable 232 emerges from coating unit 228 and is received by a take-up unit 250 that tensions the SZ cable and winds it around a take-up spool 260.

Apparatus 10 of the present disclosure eliminates the mechanical coupling between rotatable guide members 20R and in this sense is a gearless and shaftless apparatus. Note that the strands 40 passing through the rotatable guide members 20R do not establish a mechanical coupling between the guide members because the strands are not used to drive the rotation of the guide members. Without the added rotational inertia and bearing friction associated with mechanical components, faster reversal times and thus higher line speeds are possible for a given lay length. Gear-based SZ cable-stranding apparatus are also subject to extremely high dynamic loads during the reversals. This puts a great deal of stress on the power transmission gears, resulting in frequent maintenance issues. The gearless/shaftless SZ cable-stranding apparatus 10 eliminate these types of maintenance and reliability issues.

Because the motion of rotatable guide members 20R is electronically controlled, their rotational velocities in relation to other plates is programmable according to a rotation relationship to carry out rotation profiles (including complex rotation profiles) that result in smoother operation and lower tension variations on strands 40 and the at least on core member 30. The prior art mechanical approaches limit the rotation profiles of the rotatable guide members, which causes unwanted variations in strand tension.

It will be apparent to those skilled in the art that various modifications to the present embodiment of the disclosure as described herein can be made without departing from the spirit or scope of the disclosure as defined in the appended claims. Thus, the disclosure covers the modifications and variations provided they come within the scope of the appended claims and the equivalents thereto.

What is claimed is:

1. A method of stranding strand elements in an SZ configuration to form an SZ-stranded assembly, comprising:

passing, using at least one guide member, initially spaced apart strand elements through respective guide holes and at least one core member through a generally central location of the guide member;

actuating a controller that controls the rotation of the at least one guide member and rotating the at least one guide member to form the SZ-stranded assembly; and operably disposing the at least one guide member in at least one hollow-shaft motor to rotate the at least one guide member, and driving the at least one motor according to a rotation relationship.

2. A method of stranding strand elements in an SZ configuration to form an SZ-stranded assembly, comprising:

passing using at least one guide member, initially spaced apart strand elements through respective guide holes and at least one core member through a generally central location of the guide member;

actuating a controller that controls the rotation of the at least one guide member and rotating the at least one guide member to form the SZ-stranded assembly; and passing the initially spaced apart strand elements and the at least one core member through a plurality of guide members that are not mechanically coupled.

3. The method of claim 1, including passing the strand elements through an upstream stationary guide member to form the initially spaced apart strand elements.

4. The method of claim 1, including providing the at least one guide member in the form of a layplate having a central hole that passes the at least one core member and peripheral guide holes that individually pass the strand elements.

5. The method of claim 1, including driving the at least one motor by a corresponding at least one servo driver according to the rotation relationship.

6. The method of claim 5, further including providing the rotation relationship as a programmed set of instructions in a controller electrically connected to the at least one servo driver.

7. The method of claim 6, further comprising using multiple motors, and providing the rotation relationship with individual motor rotation profiles that are independent of rotation profiles of the other motors.

8. The method of claim 1, further including a most downstream motor and at least one upstream motor, and slaving the at least one upstream motor to the most downstream motors.

9. The method of claim 1, further comprising coating the stranded SZ-assembly with a protective coating to form an SZ cable.

10. A method of forming an apparatus for controlling strand elements and at least one core member in a stranding apparatus, comprising:

providing at least one motor having an associated rotating guide member driver;

providing and operably disposing a guide member at least partially within the rotating guide member driver so that the guide member rotates with the guide member driver, wherein the guide member is configured to receive and individually guide the strand elements and pass the at least one core member; and providing and plurality of motors such that associated guide member drivers are axially aligned.

11. The method of claim 10, wherein providing the guide member comprises providing the guide member as a layplate having peripheral guide holes for guiding individual strand elements and a central hole that passes the at least one core member.

12. The method of claim 10, further comprising securing the guide member to the guide member driver using a plurality of set screws.

13. The method of claim 10, wherein the guide member driver comprises a hollow shaft.

14. The method of claim 10, further comprising providing the motor as an inductively driven servo motor.

15. The method of claim 14, further comprising providing a servo-driver and electrically connecting it to the servo motor, and providing a controller and electrically connecting it to the servo driver.

16. A method of forming a cable stranding apparatus that strands strand elements about at least one core member in an SZ configuration to form a SZ-stranded assembly, comprising:

providing a plurality of motors each having a guide member driver;

aligning the guide member drivers along an apparatus axis;

providing a plurality of guide members configured to locally spatially separate the individual strand elements and pass the at least one core member;

disposing and holding stationary one of the guide members upstream of the plurality of motors; and disposing the remaining guide members at least partially within respective guide member drivers so as to rotate with the respective guide member drivers.

17. The method of claim 16, further comprising:

electrically connecting to at least one motor at least one servo driver that is operable to provide signals to the at least one motor to cause the associated guide member driver to rotate and periodically reverse direction; and electrically connecting a controller to the at least one servo driver, wherein the controller is configured to provide control signals that cause the at least one servo driver to drive the corresponding motors according to a rotation relationship.

18. The method of claim 16, further comprising operably arranging a linespeed monitoring device relative to the apparatus axis, the linespeed monitoring device being configured to measure a linespeed of at least one of the at least one core member as it passes through the guide members and the SZ-stranded assembly as it exits the most downstream guide member.

19. The method of claim 16, further comprising providing a least one of the plurality of guide members as a round layplate having peripheral guide holes sized to accommodate individual strand elements and a central hole sized to pass the at least one core member.

20. The method of claim 16, further comprising securing the guide members to its respective guide member driver using a plurality of set screws.

21. The method of claim 16, further comprising providing the motors as hollow-shaft motors, wherein the hollow shafts serve as the guide member drivers.

22. The method of claim 16, further comprising configuring the plurality of motors to be axially adjustable relative to one another so as to have an adjustable spacing between adjacent motors.

23. The method of claim 22, further comprising disposing the plurality of motors on at least one rail so that the motors are axially slidably adjustable relative to one another.

* * * * *